US007108893B2

(12) United States Patent
Van Steenkiste et al.

(10) Patent No.: US 7,108,893 B2
(45) **Date of Patent: *Sep. 19, 2006**

(54) SPRAY SYSTEM WITH COMBINED KINETIC SPRAY AND THERMAL SPRAY ABILITY

(75) Inventors: Thomas Hubert Van Steenkiste, Ray, MI (US); Brian K Fuller, Rochester Hills, MI (US)

(73) Assignee: Delphi Technologies, Inc., Troy, MI (US)

( * ) Notice: Subject to any disclaimer, the term of this patent is extended or adjusted under 35 U.S.C. 154(b) by 88 days.

This patent is subject to a terminal disclaimer.

(21) Appl. No.: 10/616,490

(22) Filed: Jul. 9, 2003

(65) Prior Publication Data

US 2004/0058065 A1 Mar. 25, 2004

Related U.S. Application Data

(63) Continuation-in-part of application No. 10/417,495, filed on Apr. 17, 2003, now Pat. No. 6,743,468, which is a continuation of application No. 10/252,203, filed on Sep. 23, 2002, now abandoned.

(51) Int. Cl.
*C23C 4/12* (2006.01)

(52) U.S. Cl. ..... 427/446; 427/447; 427/453; 427/455; 427/456; 427/422

(58) Field of Classification Search ..... 427/446, 427/455, 456, 422
See application file for complete search history.

(56) References Cited

U.S. PATENT DOCUMENTS 2,861,900 A 11/1958 Smith et al.
3,100,724 A 8/1963 Rocheville
3,723,165 A * 3/1973 Longo et al. ..... 427/447
3,876,456 A 4/1975 Ford et al.
3,993,411 A 11/1976 Babcock et al.
3,996,398 A 12/1976 Manfredi
4,263,335 A 4/1981 Wagner et al.
4,416,421 A * 11/1983 Browning ..... 239/79
4,606,495 A 8/1986 Stewart, Jr. et al.
4,891,275 A 1/1990 Knoll
4,938,991 A * 7/1990 Bird ..... 427/190
4,939,022 A 7/1990 Palanisamy
5,187,021 A 2/1993 Vydra et al.
5,217,746 A 6/1993 Lenling et al.
5,271,965 A 12/1993 Browning (Continued)

FOREIGN PATENT DOCUMENTS

DE 42 36 911 12/1993

(Continued)

OTHER PUBLICATIONS

Van Steenkiste, et al; Kinetic Spray Coatings; in Surface & Coatings Technology III; 1999, pp. 62-71.

(Continued)

*Primary Examiner*—Katherine Bareford
(74) *Attorney, Agent, or Firm*—Scott A. McBain

(57) ABSTRACT

Disclosed is a system and a method for simultaneously applying a kinetic spray coating and a thermal spray coating onto a substrate using a single application nozzle to produce a combined coating. The system may include a higher heat capacity gas heater to permit both the thermal spray and the kinetic spray. The method involves providing two populations of particles to the nozzle simultaneously wherein one population is thermally softened in the nozzle under the spray parameters and the other is not. The system increases the versatility of the spray nozzle and addresses several problems inherent in kinetic spray applied coatings.

15 Claims, 4 Drawing Sheets

U.S. PATENT DOCUMENTS

| | | | | |
|---|---|---|---|---|
| 5,302,414 | A | 4/1994 | Alkhimov et al. | |
| 5,308,463 | A | 5/1994 | Hoffmann et al. | |
| 5,340,015 | A | 8/1994 | Hira et al. | |
| 5,362,523 | A | 11/1994 | Gorynin et al. | |
| 5,395,679 | A | 3/1995 | Myers et al. | |
| 5,464,146 | A | 11/1995 | Zalvzec et al. | |
| 5,476,725 | A | 12/1995 | Papich et al. | |
| 5,525,570 | A | 6/1996 | Chakraborty et al. | |
| 5,527,627 | A | 6/1996 | Lautzenhiser et al. | |
| 5,531,590 | A * | 7/1996 | Browning | 431/8 |
| 5,585,574 | A | 12/1996 | Sugihara et al. | |
| 5,593,740 | A | 1/1997 | Strumbon et al. | |
| 5,648,123 | A | 7/1997 | Kuhn et al. | |
| 5,683,615 | A | 11/1997 | Munoz | |
| 5,795,626 | A | 8/1998 | Gabel et al. | |
| 5,854,966 | A | 12/1998 | Kampe et al. | |
| 5,875,626 | A | 3/1999 | Cromartie | |
| 5,887,335 | A | 3/1999 | Garshells | |
| 5,889,215 | A | 3/1999 | Kilmartin et al. | |
| 5,894,054 | A | 4/1999 | Paruchuri et al. | |
| 5,907,761 | A | 5/1999 | Tohma et al. | |
| 5,952,056 | A | 9/1999 | Jordan et al. | |
| 5,965,193 | A | 10/1999 | Ning et al. | |
| 5,989,310 | A | 11/1999 | Chu et al. | |
| 6,033,622 | A | 3/2000 | Maruyama | |
| 6,051,045 | A | 4/2000 | Narula et al. | |
| 6,051,277 | A | 4/2000 | Claussen et al. | |
| 6,074,737 | A | 6/2000 | Jordan et al. | |
| 6,119,667 | A | 9/2000 | Boyer et al. | |
| 6,129,948 | A | 10/2000 | Plummet et al. | |
| 6,139,913 | A | 10/2000 | Van Steenkiste et al. | |
| 6,149,736 | A | 11/2000 | Sukigara et al. | |
| 6,159,430 | A | 12/2000 | Foster | |
| 6,189,663 | B1 | 2/2001 | Smith et al. | |
| 6,283,386 | B1 | 9/2001 | Van Steenkiste et al. | |
| 6,283,859 | B1 | 9/2001 | Carlson et al. | |
| 6,289,748 | B1 | 9/2001 | Lin et al. | |
| 6,338,827 | B1 | 1/2002 | Nelson et al. | |
| 6,402,050 | B1 | 6/2002 | Kashirin et al. | |
| 6,422,360 | B1 | 7/2002 | Oliver et al. | |
| 6,465,039 | B1 | 10/2002 | Pinkerton et al. | |
| 6,485,852 | B1 | 11/2002 | Miller et al. | |
| 6,511,135 | B1 | 1/2003 | Ballinger et al. | |
| 6,537,507 | B1 | 3/2003 | Nelson et al. | |
| 6,623,704 | B1 | 9/2003 | Roth | |
| 6,623,796 | B1 | 9/2003 | Van Steenkiste | 427/189 |
| 6,624,113 | B1 | 9/2003 | Labarge et al. | |
| 6,743,468 | B1 * | 6/2004 | Fuller et al. | 427/191 |
| 2002/0071906 | A1 | 6/2002 | Rusch | |
| 2002/0102360 | A1 | 8/2002 | Subramanian et al. | |
| 2002/0112549 | A1 | 8/2002 | Cheshmehdoost et al. | |

FOREIGN PATENT DOCUMENTS

| | | |
|---|---|---|
| DE | 199 59 515 | 6/2001 |
| DE | 100 37 212 | 1/2002 |
| DE | 101 26 100 | 12/2002 |
| EP | 1 160 348 | 12/2001 |
| EP | 1245854 A2 | 12/2002 |
| JP | 55031161 | 3/1980 |
| JP | 61249541 | 11/1986 |
| JP | 04180770 | 6/1992 |
| JP | 04243524 | 8/1992 |
| WO | 98/22639 | 5/1998 |
| WO | 02/052064 | 1/2002 |
| WO | 03009934 | 2/2003 |

OTHER PUBLICATIONS

Liu, et al; Recent Development In the Fabrication of Metal Matrix-Particulate Composites Using Powder Metallurgy Techniques, in Journal of Material Science; 1994; pp. 1999-2007; National University of Singapore, Japan.

Papyrin; The Cold Gas-Dynamic Spraying Method A New Method For Coatings Deposition Promises A New Generation of Technologies, Novosibirsk, Russia, no date.

McCune, et al; Characterization of Copper And Steel Coatings Made By The Cold Gas-Dynamic Spray Method; National Thermal Spray Conference, no date.

Alkhimov, et al; A Method of "Cold" Gas-Dynamic Deposition; Sov. Phys. Kokl. 36 (12; Dec. 1990; pp. 1047-1049.

Dykuizen, et al; Impact of High Velocity Cold Spray Particles; in Journal of Thermal Spray Technology 8(4); 1999 pp. 559-564.

Swartz, et al; Thermal Resistance At Interfaces; Appl. Phys. Lett., vol. 51, No. 26, 28; Dec. 1987; pp. 2201-2201.

Davis, et al; Thermal Conductivity of Metal-Matrix Composites; J. Appl. Phys. 77(10), May 15, 1995; pp. 4494-4960.

Stoner, et al; Measurements of the Kapitza Conductance between Diamond and Several Metals; Physical Review Letters, vol. 68, No. 10, Mar. 9, 1992; pp. 1563-1566.

Stoner, et al; Kapitza conductance and heat flow between solids at temperatures from 50 to 300k; Physical review B, vol. 48, No. 22, Dec. 1, 1993-II; pp. 16374; 16387.

Johnson, et al; Diamond/Al metal matrix composites formed by the pressureless metal infiltration process; J. Mater, Res., vol. 8, No. 5, May 1993; pp. 1169-1173.

Rajan, et al; Reinforcement coatings and interfaces in Aluminum Metal Matrix Composites; pp. 3491-3503, no date.

LEC Manufacturing And Engineering Components; Lanxide Electronic Components, Inc., no date.

Dykhuizen, et al.; Gas Dynamic Principles of Cold Spray; Journal of Thermal Spray Technology; Jun. 1998; pp. 205-212.

McCune, et al; An Exploration of the Cold Gas-Dynamic Spray Method For Several Materials Systems, no date.

Ibrahim, et al; Particulate Reinforced Matrix Composites—A Review; Journal of Materials science 26; pp. 1137-1156, no date.

I.J. Garshelis, et al; A Magnetoelastic Torque Transducer Utilizing a Ring Divided Into Two Oppositely Polarized Circumferential Regions; MMM 1995; Paper No. BB-08.

I.J. Garshelis, et al; Develoopment of a Non-Contact Torque Transducer For Electric Power Steering Systems; SAE Paper No. 920707; 1992; pp. 173-182.

Boley, et al; The Effects of Heat Treatment on the Magnetic Behavior of Rng—Type Magnetoelastic Torque Sensors; Proceedings of Sicon '01; Nov. 2001.

J.E. Snyder, et al; Low Coercivity Magnetostrictive Material With Giant Piezomagnetic d33, Abstract Submitted for the Mar. 1999 Meeting of the American Physical Society.

Pavel Ripka, et al; Pulse Excitation of Micro-Fluxgate Sensors, IEEE Transactions on Magnetics, vol. 37, No. 4, Jul. 2001, pp. 1998-2000.

Trifon M. Liakopoulos, et al; Ultrlahigh Resolution DC Magnetic Field Measurements Using Microfabricated FluxgateSensor Chips, University of Cincinnati, Ohio, Center For Microelectronics Sensors and MEMS, Dept. of ECECS pp. 630-631, no date.

Derac Son, A New Type of Fluxgate Mangetometer Using Apparent Coercive Field Strength Measurement, IEEE Transactions on Magnetics, vol. 25, No. 5, Sep. 1989, pp. 3420-3422.

O. Dezauri, et al; Printed Circuit Board Integrted Fluxgate Sensor, Elsevier Science S.A. (2000) Sensors and Actuators, pp. 200-203.

Moreland, Fluxgate Magnetometer, Carl W. Moreland, 1999-2000, pp. 1-9.

Ripka, et al; Symmetrical Core Improves Micro-Fluxgate Sensors, Sensors and Acutuators, Version 1, Aug. 25, 2000, pp. 1-9.
Hoton How, et al; Development of High-Sensitivity Fluxgate Magnetometer Using Single-Crystal Yttrium Iron Garnet Film as the Core Material, ElectroMagnetic Applications, Inc., no date.
Ripka, et al; Microfluxgate Sensor With Closed Core, submitted for Sensors and Actuators, Version 1, Jun. 17, 2000.
Hendriksen, et al; Digital Detection and Feedback Fluxgate Magnetometer, Meas. Sci. Technol. 7 (1996) pp. 897-903.
Cetek 930580 Compass Sensor, Specifications, Jun. 1997.
Geyger, Basic Principles Characteristics and Applications, Magnetic Amplifier Circuits, 1954, pp. 219-232.

* cited by examiner

SPRAY SYSTEM WITH COMBINED KINETIC SPRAY AND THERMAL SPRAY ABILITY

RELATED APPLICATIONS

This application is a continuation-in-part of U.S. application Ser. No. 10/417,495, filed Apr. 17, 2003, now U.S. Pat. No. 6,743,468, which is a continuation of U.S. application Ser. No. 10/252,203, filed Sep. 23, 2002, now abandoned.

TECHNICAL FIELD

The present invention is a method and an apparatus for applying a coating to a substrate, and more particularly, to a method and an apparatus for applying both a kinetic spray coating and a thermal spray coating from the same nozzle.

BACKGROUND OF THE INVENTION

A new technique for producing coatings on a wide variety of substrate surfaces by kinetic spray, or cold gas dynamic spray, was recently reported in articles by T. H. Van Steenkiste et al., entitled "Kinetic Spray Coatings," published in Surface and Coatings Technology, vol. 111, pages 62–71, Jan. 10, 1999 and "Aluminum coatings via kinetic spray with relatively large powder particles" published in Surface and Coatings Technology 154, pages 237–252, 2002. The articles discuss producing continuous layer coatings having low porosity, high adhesion, low oxide content and low thermal stress. The articles describe coatings being produced by entraining metal powders in an accelerated air stream, through a converging-diverging de Laval type nozzle and projecting them against a target substrate. The particles are accelerated in the high velocity air stream by the drag effect. The air used can be any of a variety of gases including air or helium. It was found that the particles that formed the coating did not melt or thermally soften prior to impingement onto the substrate. It is theorized that the particles adhere to the substrate when their kinetic energy is converted to a sufficient level of thermal and mechanical deformation. Thus, it is believed that the particle velocity must be high enough to exceed the yield stress of the particle to permit it to adhere when it strikes the substrate. It was found that the deposition efficiency of a given particle mixture was increased as the inlet air temperature was increased. Increasing the inlet air temperature decreases its density and increases its velocity. The velocity of the main gas varies approximately as the square root of the inlet air temperature. The actual mechanism of bonding of the particles to the substrate surface is not fully known at this time. It is believed that the particles must exceed a critical velocity prior to their being able to bond to the substrate. The critical velocity is dependent on the material of the particle and to a lesser degree on the material of the substrate. It is believed that the initial particles to adhere to a substrate have broken the oxide shell on the substrate material permitting subsequent metal to metal bond formation between plastically deformed particles and the substrate. Once an initial layer of particles has been formed on a substrate subsequent particles bind not only to the voids between previous particles bound to the substrate but also engage in particle to particle bonds. The bonding process is not due to melting of the particles in the air stream because while the temperature of the air stream may be above the melting point of the particles, due to the short exposure time the particles are never heated to a temperature above their melt temperature. This feature is considered critical because the kinetic spray process allows one to deposit particles onto a surface with out a phase transition.

This work improved upon earlier work by Alkimov et al. as disclosed in U.S. Pat. No. 5,302,414, issued Apr. 12, 1994. Alkimov et al. disclosed producing dense continuous layer coatings with powder particles having a particle size of from 1 to 50 microns using a supersonic spray.

The Van Steenkiste articles reported on work conducted by the National Center for Manufacturing Sciences (NCMS) and by the Delphi Research Labs to improve on the earlier Alkimov process and apparatus. Van Steenkiste et al. demonstrated that Alkimov's apparatus and process could be modified to produce kinetic spray coatings using particle sizes of greater than 50 microns.

The modified process and apparatus for producing such larger particle size kinetic spray continuous layer coatings are disclosed in U.S. Pat. Nos. 6,139,913, and 6,283,386. The process and apparatus described provide for heating a high pressure air flow and combining this with a flow of particles. The heated air and particles are directed through a de Laval-type nozzle to produce a particle exit velocity of between about 300 m/s (meters per second) to about 1000 m/s. The thus accelerated particles are directed toward and impact upon a target substrate with sufficient kinetic energy to bond the particles to the surface of the substrate. The temperatures and pressures used are sufficiently lower than that necessary to cause particle melting or thermal softening of the selected particle. Therefore, as discussed above, no phase transition occurs in the particles prior to bonding. It has been found that each type of particle material has a threshold critical velocity that must be exceeded before the material begins to adhere to the substrate by the kinetic spray process.

One difficulty associated with all of these prior art kinetic spray systems arises from defects in the substrate surface. When the surface has an imperfection in it the kinetic spray coating may develop a conical shaped defect over the surface imperfection. The conical defect that develops in the kinetic spray coating is stable and can not be repaired by the kinetic spray process, hence the piece must be discarded. A second difficulty arises when the substrate is a softer plastic or a soft ceramic composite. These materials can not be coated by a kinetic spray process because the particles being sprayed bury themselves below the surface rather than deforming and adhering to the surface.

SUMMARY OF THE INVENTION

In one embodiment, the present invention is a method of coating a substrate comprising the steps of: providing at least a first population of particles and a second population of particles to be sprayed; providing a supersonic nozzle having a throat located between a converging region and a diverging region, directing a flow of a gas through the nozzle, maintaining the gas at a selected temperature, and injecting the first and second populations of particles into the nozzle at the same time and entraining the first and second populations of particles in the flow of the gas; the temperature of the gas selected to be insufficient to heat the first population of particles to a temperature at or above their melting temperature in the nozzle and accelerating the particles to a velocity sufficient to result in adherence of the particles on a substrate positioned opposite the nozzle, and the temperature of the gas selected to be sufficient to heat the second population of particles to a temperature at or above their melting temperature in the nozzle thereby melting the second population of particles and accelerating the molten particles to a velocity sufficient to result in adherence of the particles on the substrate; thereby forming a coating on the substrate that is a combination of the first and second populations of particles.

BRIEF DESCRIPTION OF THE DRAWINGS

The present invention will now be described, by way of example, with reference to the accompanying drawings, in which.

DESCRIPTION OF THE PREFERRED EMBODIMENT

The present invention comprises an improvement to the kinetic spray process as generally described in U.S. Pat. Nos. 6,139,913, 6,283,386 and the articles by Van Steenkiste, et al. entitled "Kinetic Spray Coatings" published in Surface and Coatings Technology Volume III, Pages 62–72, Jan. 10, 1999, and "Aluminum coatings via kinetic spray with relatively large powder particles" published in Surface and Coatings Technology 154, pages 237–252, 2002 all of which are herein incorporated by reference.

Figure 1:
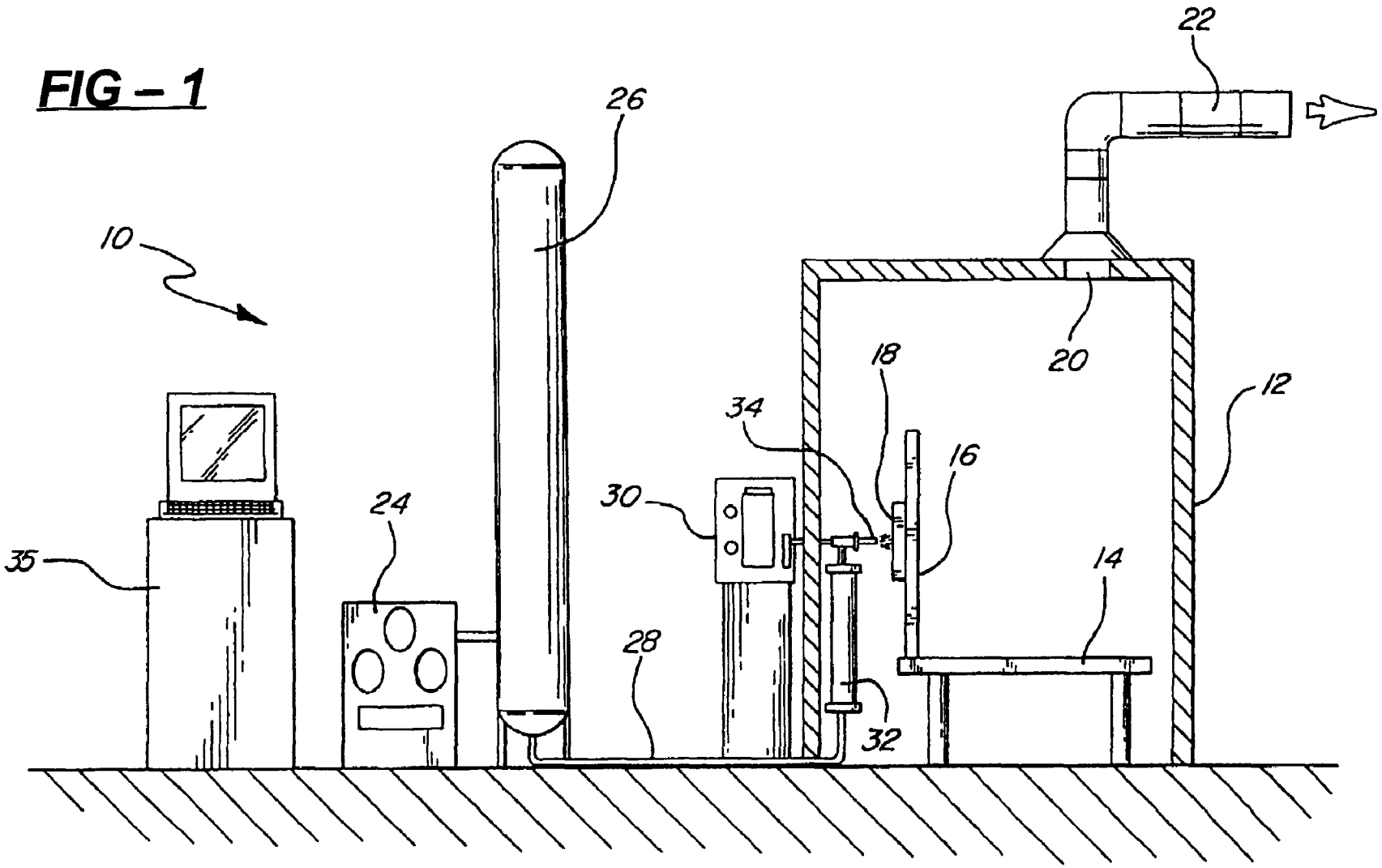
FIG. 1 is a generally schematic layout illustrating a kinetic spray system for performing the method of the present invention.

Referring first to FIG. 1, a kinetic spray system according to the present invention is generally shown at 10. System 10 includes an enclosure 12 in which a support table 14 or other support means is located. A mounting panel 16 fixed to the table 14 supports a work holder 18 capable of movement in three dimensions and able to support a suitable workpiece formed of a substrate material to be coated. The enclosure 12 includes surrounding walls having at least one air inlet, not shown, and an air outlet 20 connected by a suitable exhaust conduit 22 to a dust collector, not shown. During coating operations, the dust collector continually draws air from the enclosure 12 and collects any dust or particles contained in the exhaust air for subsequent disposal.

The spray system 10 further includes an air compressor 24 capable of supplying air pressure up to 3.4 MPa (500 psi) to a high pressure air ballast tank 26. The air ballast tank 26 is connected through a line 28 to both a powder feeder 30 and a separate air heater 32. The air heater 32 supplies high pressure heated air, the main gas described below, to a kinetic spray nozzle 34. The powder feeder 30 mixes particles of a spray powder with unheated air and supplies the mixture to a supplemental inlet line 48 of the nozzle 34. The particles can either be homogeneous or a mixture of materials, sizes, shapes, etc. A computer control 35 operates to control both the pressure of air supplied to the air heater 32 and the temperature of the heated main gas exiting the air heater 32. The main gas can comprise air, argon, nitrogen helium and other inert gases.

Figure 2:
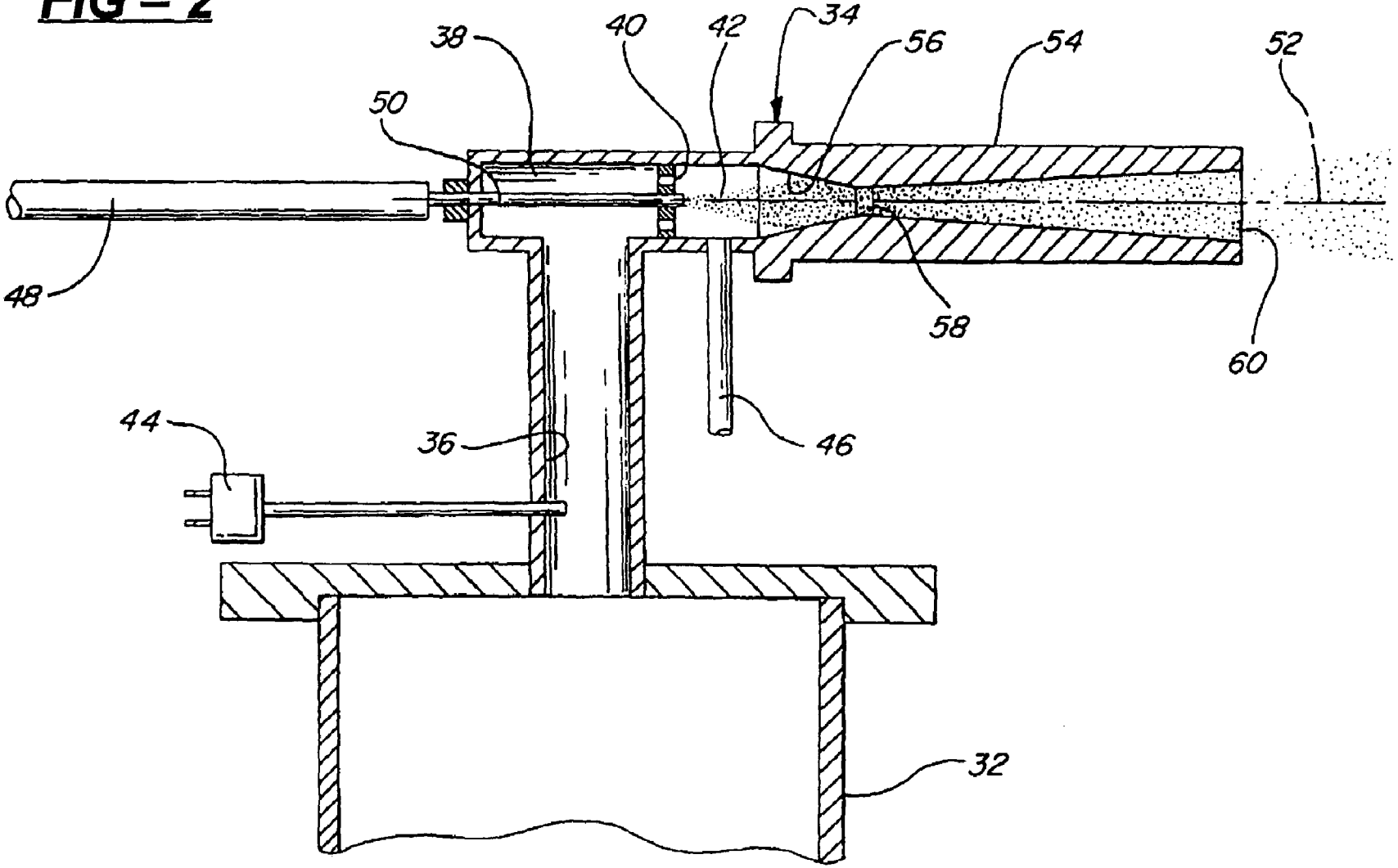
FIG. 2 is an enlarged cross-sectional view of one embodiment of a kinetic spray nozzle used in the system.

FIG. 2 is a cross-sectional view of one embodiment of the nozzle 34 and its connections to the air heater 32 and the supplemental inlet line 48. A main air passage 36 connects the air heater 32 to the nozzle 34. Passage 36 connects with a premix chamber 38 which directs air through a flow straightener 40 and into a mixing chamber 42. Temperature and pressure of the air or other heated main gas are monitored by a gas inlet temperature thermocouple 44 in the passage 36 and a pressure sensor 46 connected to the mixing chamber 42.

This embodiment of the nozzle 34 requires a high pressure powder feeder 30. With this nozzle 34 and supplemental inlet line 48 set-up the powder feeder 30 must have pressure sufficient to overcome that of the heated main gas. The mixture of unheated high pressure air and coating powder is fed through the supplemental inlet line 48 to a powder injector tube 50 comprising a straight pipe having a predetermined inner diameter. When the particles have an average nominal diameter of from 50 to 106 microns it is preferred that the inner diameter of the tube 50 range from 0.4 to 3.0 millimeters. When larger particles of 106 to 250 microns are used it is preferable that the inner diameter of the tube 50 range from 0.40 to 0.90 millimeters. The tube 50 has a central axis 52 that is preferentially the same as the axis of the premix chamber 38. The tube 50 extends through the premix chamber 38 and the flow straightener 40 into the mixing chamber 42.

Mixing chamber 42 is in communication with the de Laval type supersonic nozzle 54. The nozzle 54 has an entrance cone 56 that forms a converging region which decreases in diameter to a throat 58. Downstream of the throat is a diverging region that ends in an exit end 60. The largest diameter of the entrance cone 56 may range from 10 to 6 millimeters, with 7.5 millimeters being preferred. The entrance cone 56 narrows to the throat 58. The throat 58 may have a diameter of from 3.5 to 1.5 millimeters, with from 3 to 2 millimeters being preferred. The portion of the nozzle 54 from downstream of the throat 58 to the exit end 60 may have a variety of shapes, but in a preferred embodiment it has a rectangular cross-sectional shape. When particles of from 50 to 106 microns are used the length from the throat 58 to the exit end 60 can range from 60.0 to 80.0 millimeters, however, when particles of from 106 to 250 microns are used then preferably the distance from the throat 58 to the exit end 60 ranges from 200.0 to 400.0 millimeters. At the exit end 60 the nozzle 54 preferably has a rectangular shape with a long dimension of from 8 to 14 millimeters by a short dimension of from 2 to 6 millimeters.

As disclosed in U.S. Pat. Nos. 6,139,913 and 6,283,386 the powder injector tube 50 supplies a particle powder mixture to the system 10 under a pressure in excess of the pressure of the heated main gas from the passage 36 using the nozzle 54 shown in FIG. 2. The nozzle 54 produces an exit velocity of the entrained particles of from 300 meters per second to as high as 1200 meters per second. The entrained particles gain kinetic and thermal energy during their flow through this nozzle 54. It will be recognized by those of skill in the art that the temperature of the particles in the gas stream will vary depending on the particle size, the material composition of the particles, and the main gas temperature. The main gas temperature is defined as the temperature of heated high-pressure gas at the inlet to the nozzle 54.

Figure 3:
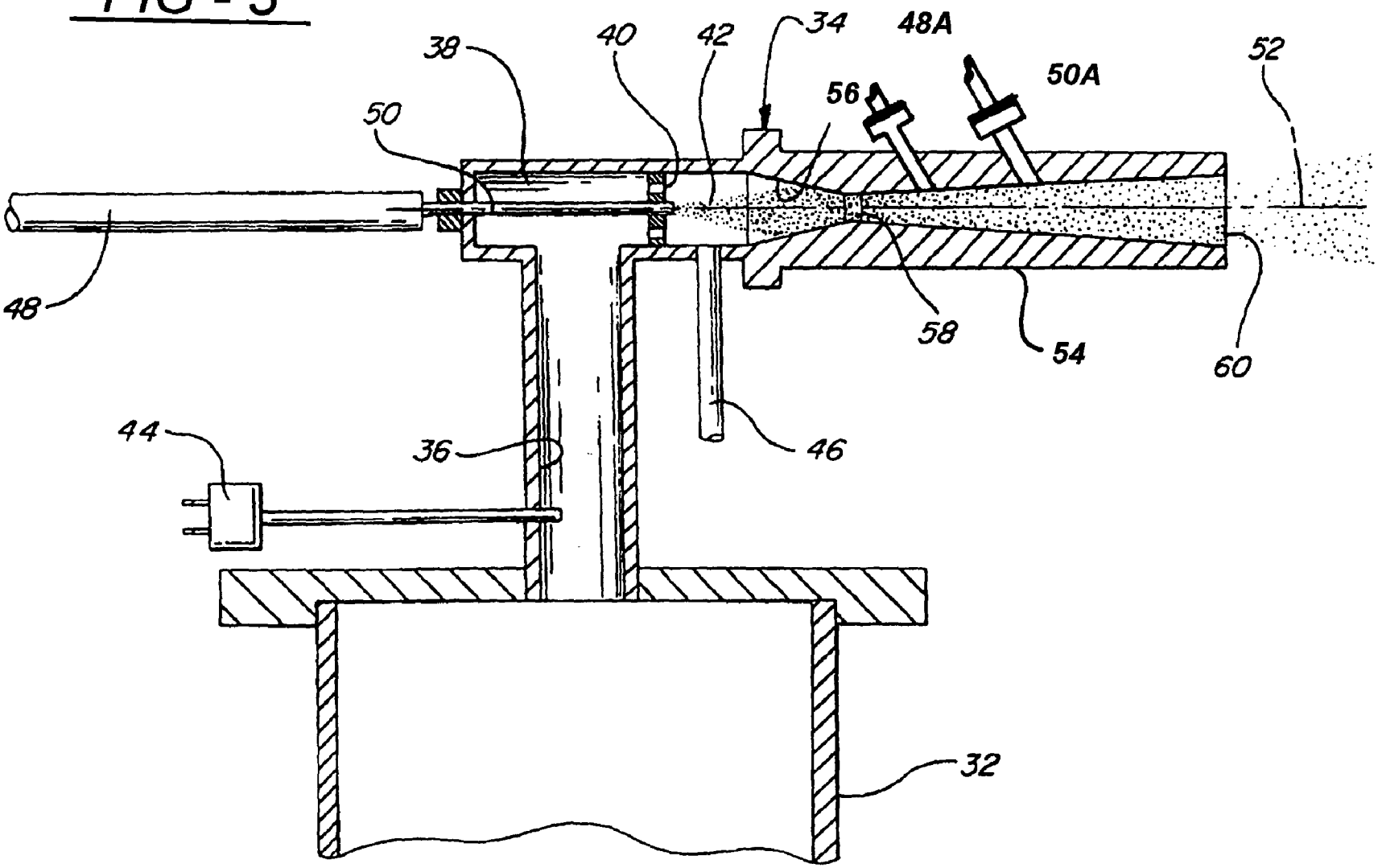
FIG. 3 is an enlarged cross-sectional view of an alternative embodiment of a kinetic spray nozzle used in the system.

FIG. 3 is a cross-sectional view of another embodiment of the nozzle 34 and its connections to the air heater 32 and to at least two powder feeders 30. A main air passage 36 connects the air heater 32 to the nozzle 34. Passage 36 connects with a premix chamber 38 that directs air through a flow straightener 40 and into a chamber 42. Temperature and pressure of the air or other heated main gas are monitored by a gas inlet temperature thermocouple 44 in the passage 36 and a pressure sensor 46 connected to the chamber 42.

Chamber 42 is in communication with a de Laval type supersonic nozzle 54. The nozzle 54 has a central axis 52 and an entrance cone 56 that decreases in diameter to a throat 58. The entrance cone 56 forms a converging region of the nozzle 54. Downstream of the throat 58 is an exit end 60 and a diverging region is defined between the throat 58 and the exit end 60. The largest diameter of the entrance cone 56 may range from 10 to 6 millimeters, with 7.5 millimeters being preferred. The entrance cone 56 narrows to the throat 58. The throat 58 may have a diameter of from 3.5 to 1.5 millimeters, with from 3 to 2 millimeters being preferred. The diverging region of the nozzle 54 from downstream of the throat 58 to the exit end 60 may have a variety of shapes, but in a preferred embodiment it has a rectangular cross-sectional shape. At the exit end 60 the nozzle 54 preferably has a rectangular shape with a long dimension of from 8 to 14 millimeters by a short dimension of from 2 to 6 millimeters.

The de Laval nozzle 54 of FIG. 3 is modified from the embodiment shown in FIG. 2 in the diverging region. In this embodiment, there are two ways to entrain particles in the main gas air flow. One route is as described above for FIG. 2. In another route, a mixture of heated or unheated low pressure air and coating powder is fed from a powder feeder 30 through one of a plurality of supplemental inlet lines 48A each of which is connected to a powder injector tube 50A comprising a tube having a predetermined inner diameter, described above. For simplicity the actual connections between the powder feeder 30 and the inlet lines 48 and 48A are not shown. The injector tubes 50A supply the particles to the nozzle 54 in the diverging region downstream from the throat 58, which is a region of reduced pressure, hence, in this embodiment one of the powder feeders 30 can be a low pressure powder feeder, discussed below. The length of the nozzle 54 from the throat 58 to the exit end can vary widely and typically ranges from 100 to 400 millimeters.

As would be understood by one of ordinary skill in the art the number of injector tubes 50A, the angle of their entry relative to the central axis 52 and their position downstream from the throat 58 can vary depending on any of a number of parameters. In FIG. 3 two injector tubes 50A are shown, but the number can be as low as one and as high as the available room of the diverging region. The angle relative to the central axis 52 can be any that ensures that the particles are directed toward the exit end 60, basically from 1 to about 90 degrees. It has been found that an angle of 45 degrees relative to central axis 52 works well. As for the embodiment of FIG. 2, the inner diameter of the injector tube 50A can vary between 0.4 to 3.0 millimeters. The use of multiple injector tubes 50A in this nozzle 54 permits one to easily modify the system 10. One can rapidly change particles by turning off a first powder feeder 30 connected to a first injector tube 50A and the turning on a second powder feeder 30 connected to a second injector tube 50A. Such a rapid change over is not easily accomplished with the embodiment shown in FIG. 2. For simplicity only one powder feeder 30 is shown in FIG. 1, however, as would be understood by one of ordinary skill in the art, the system 10 could include a plurality of powder feeders 30. The nozzle 54 of FIG. 3 also permits one to mix a number of powders in a single injection cycle by having a plurality of powder feeders 30 and injector tubes 50A functioning simultaneously. An operator can also run a plurality of particle populations, each having a different average nominal diameter, with the larger population being injected closer to the throat 58 relative to the smaller size particle populations and still get efficient deposition. The nozzle 54 of FIG. 3 will permit an operator to better optimize the deposition efficiency of a particle or mixture of particles. For example, it is known that harder materials have a higher critical velocity, therefore in a mixture of particles the harder particles could be introduced at a point closer to the throat 58 thereby giving a longer acceleration time.

Using a de Laval nozzle 54 like that shown in FIG. 3 having a length of 300 millimeters from throat 58 to exit end 60, a throat of 2 millimeters and an exit end 60 with a rectangular opening of 5 by 12.5 millimeters the pressure drops quickly as one goes downstream from the throat 58. The measured pressures were: 14.5 psi at 1 inch after the throat 58; 20 psi at 2 inches from the throat 58; 12.8 psi at 3 inches from the throat 58; 9.25 psi at 4 inches from the throat 58; 10 psi at 5 inches from the throat 58 and below atmospheric pressure beyond 6 inches from the throat 58. These results show why one can use much lower pressures to inject the powder when the injection takes place after the throat 58. The low pressure powder feeder 30 that can be used with the nozzle 54 of FIG. 3 has a cost that is approximately ten-fold lower than the high pressure powder feeders 30 that need to be used with the nozzle 34 of FIG. 2. Generally, the low pressure powder feeder 30 is used at a pressure of 100 psi or less. All that is required is that it exceed the main gas pressure at the point of injection.

The system 10 of the present invention can be operated in two modes simultaneously. The two modes are a kinetic spray mode and a thermal spray mode. In the kinetic spray mode the particles of a first population of particles are not heated to a temperature above their melting point during their acceleration by passage through the nozzle 54 and thus they do not thermally soften and they strike the substrate without a phase change. The particles in this population adhere to the substrate if their critical velocity has been exceeded. In the thermal spray mode the particles of a second population of particles are heated to a temperature at or above their melting point during their acceleration by passage through the nozzle 54 and thus they are thermally softened and exit the nozzle 54 as molten particles. The particles of the second population do under go a phase change and they adhere to the substrate upon striking it.

This is accomplished by careful choice of the characteristics of the first and second population particles. Through proper choice the same main gas temperature can be used to thermally soften one of the populations while not thermally softening the other population. The thermal energy a given particle gains during acceleration in the nozzle 54 is dependent on the amount of time it spends exposed to the main gas regardless of whether it enters through injector 50 or 50A.

When both populations are composed from the same material the two populations can be created by having a first population that has a smaller average nominal diameter than a second population. Provided there is sufficient size difference the smaller particles will be thermally softened at a main gas temperature that is insufficient to thermally soften the larger particles. Thus by feeding a mixture of large and small particles through the powder feeder 30 one can simultaneously create a thermal spray and a kinetic spray coating on a substrate. Another way to create two populations using the same material composition is to have a first population composed of spherical particles and a second population formed from irregular shaped particles. The irregular shapes can be flakes, needles, rods, etc. The irregular shaped particles will not accelerate as rapidly and thus they will have a longer residence time in the nozzle 54 and will be thermally softened at a lower main gas temperature compared to the spherical particles. The ability to melt one population and not another can be used to provide several unique effects. First, the properties of the coating will be a combination of the two. The melted population can be used to introduce oxides into the coating. These oxides may be advantageous for increasing chemical or wear resistance of the coating. The oxides may also increase lubricity of the coating. The combined population may be used to modify the stress characteristics of the coating. Kinetic spray only coatings are cold worked during coating development. Other properties that can be changed by the thermal spray mode are the hardness of the particles that are melted, thus the combined coating may have a different hardness from a solely kinetically sprayed coating. The melting particles can undergo a phase change such that they are initially iron particles with a high level of austenite and after thermal spraying the coating may have thermally applied particles that have phase shifted to martensite or pearlite. One of the other characteristics that can be changed by the melting is the grain size of the coating. Kinetic spraying does not result in a change in grain size, the combined spraying can result in a coating with multiple grain sizes.

It is also possible to practice the present intention by using particles formed from different materials. The different materials may also have different sizes or shapes as discussed above. The important parameter is that the two populations have different thermal softening points in the system 10 whether due to inherent melting point differences or due to residence time differences. Of example one population can be composed of aluminum and the other of copper. The copper particles have a much higher melting point than aluminum. Another variation would be to have the copper particles and two populations of aluminum particles that differ in size. This triple population could be used to create a coating wherein the small aluminum particles are thermally sprayed while the large aluminum and copper particles are kinetically sprayed. Other combinations might include a metal such as aluminum and a ceramic like silicon carbide.

This dual mode capacity can be benefited by using an air heater 32 that is capable of achieving higher temperatures than a typical kinetic spray system. This higher capacity air heater 32 may require that the main air passage 36, supplemental inlet lines 48, 48A, tubes 50, 50A and nozzle 34 be made of high heat resistant materials.

The computer control 35 and the thermocouple 44 interact to monitor and maintain the main gas at a temperature that is always insufficient to cause melting in the nozzle 34 of one of the populations of particles being sprayed. The main gas temperature can be well above the melt temperature of both populations melting points and may range from at least 300 to at least 3000 degrees Celsius. Main gas temperatures that are 5 to 7 fold above the melt temperature of the populations particles have been used in the present system 10. What is necessary is that the temperature and exposure time to the main gas be selected such that one populations particles melt or thermally soften in the nozzle 34 and the other population's particles do not. The temperature of the gas rapidly falls as it travels through the nozzle 34. In fact, the temperature of the gas measured as it exits the nozzle 34 is often at or below room temperature even when its initial temperature is above 1000° F.

Since in the kinetic mode the temperature of the particles is always less than the melting point of the particles, even upon impact on a substrate placed opposite the nozzle 34, there is no change in the solid phase of the original particles due to transfer of kinetic and thermal energy, and therefore no change in their original physical properties.

Upon striking a substrate opposite the nozzle 54 the kinetic sprayed particles flatten into a nub-like structure with an aspect ratio of generally about 5 to 1. When the substrate is a metal and the particles are a metal the particles striking the substrate surface fracture the oxidation on the surface layer and any oxides on bonded particles and subsequently form a direct metal-to-metal bond between the metal particle and the metal substrate. Upon impact the kinetic sprayed particles transfer substantially all of their kinetic and thermal energy to the substrate surface and stick if their yield stress has been exceeded. As discussed above, for a given particle to adhere to a substrate during the kinetic spray mode it is necessary that it reach or exceed its critical velocity which is defined as the velocity where at it will adhere to a substrate when it strikes the substrate after exiting the nozzle. This critical velocity is dependent on the material composition of the particle. In general, harder materials must achieve a higher critical velocity before they adhere to a given substrate. It is not known at this time exactly what is the nature of the particle to substrate bond; however, it is believed that a portion of the bond is due to the particles plastically deforming upon striking the substrate.

As disclosed in U.S. Pat. No. 6,139,913 the substrate material may be comprised of any of a wide variety of materials including a metal, an alloy, a semi-conductor, a ceramic, a plastic, and mixtures of these materials. Other substrates include wood and paper. All of these substrates can be coated by the process of the present invention in either mode of operation. The particles used in the present invention may comprise any of the materials disclosed in U.S. Pat. Nos. 6,139,913 and 6,283,386 in addition to other known particles. These particles generally comprise metals, alloys, ceramics, polymers, diamonds and mixtures of these. Preferably the particles used have an average nominal diameter of from 60 to 250 microns. Mixtures of different sized or different material compositions of particles can be used in the system 10 either by providing them as a mixture or using multiple tubes 50 and 50A and the nozzle 54 shown in FIG. 3.

The thermally sprayed population of particles exit the nozzle 34 in a molten state and strike the substrate while molten. After striking the substrate the molten particles flatten and adhere to the substrate. The system 10 allows one to thermally spray the same types of particles onto the same types of substrates. Preferably the system 10 heats the thermally sprayed particles to a temperature of from the melting point of the particles to 400 degrees Celsius above the melting point of the particles, more preferably from the melting point of the particles to 200 degrees Celsius above the melting point of the particles, and most preferably from the melting point of the particles to 100 degrees Celsius above the melting point of the particles. To accomplish this the air heater 32 is selected to have a higher heating capacity. The air heater 32 can comprise any of a number of designs including a thermal plasma heater, it may include a combustion chamber, and it may be a high temperature resistive heater element. All of these systems are known in the art. The air heater 32 just needs to be able to heat the one population of particles to temperatures above their melt points during their passage through the nozzle 34 for the thermal spray mode.

The system 10 permits a user to solve two difficulties with conventional kinetic spray systems, namely healing defective kinetic spray coatings and permitting kinetic spray coatings on softer materials. Also as described above it dramatically increases the range of coating characteristics that can be achieved with the sprayed particles. As discussed in the background above, one problem with kinetic spray systems is that if the substrate surface has any defects or imperfections these can cause conical defects in the kinetic spray applied coating. The defects appear as a right circular cone. This defect is stable in that with continued kinetic spray application the defect just becomes more evident. With a typical kinetic spray system the coating would have to be discarded and a new one begun.

The system 10 also allows a user to apply a kinetic spray coating to soft or brittle materials. Such materials may comprise certain plastics and ceramic composites. With a conventional kinetic spray system some of these materials can not be coated because the particles tend to bury themselves below the surface of the substrate or may fracture the substrate rather than plastically deforming and coating the substrate. With the present system 10 a user can apply a combined coating which will effectively coat the substrate.

EXAMPLES

Figure 4:
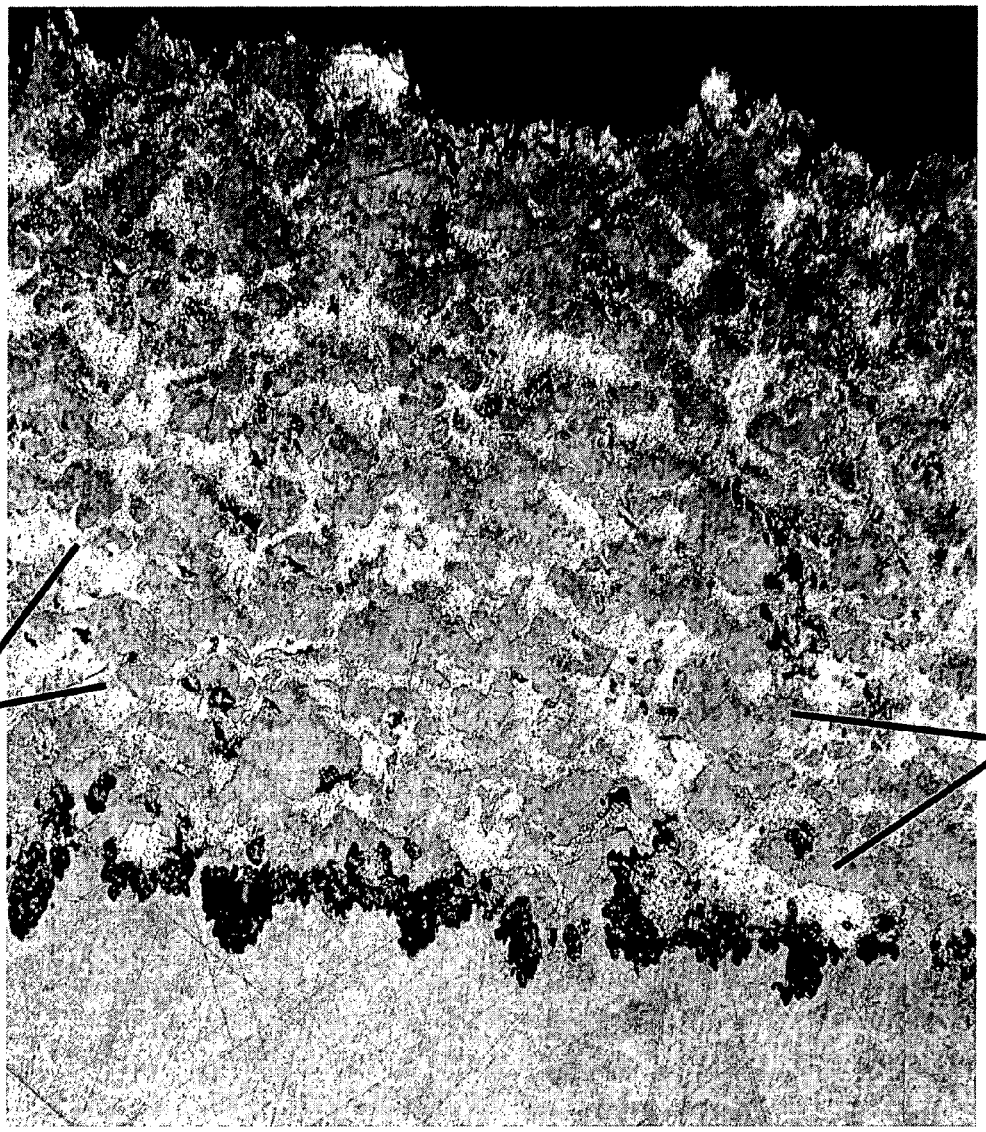
FIG. 4 is a scanning electron photomicrograph of a surface coated according to the present invention.

Using the system 10 described above a coating formed from aluminum particles and copper particles was formed. The copper particles have a much higher melting point compared to the aluminum particles. The substrate was a copper plate. The main gas temperature was set at 1200 degrees Fahrenheit, main gas pressure was set at 300 pounds per square inch (psi), powder feeder pressure at 350 psi. The stand off distance was 0.75 inches and the traverse speed was 0.5 inches per second. The mixture of particles was 25% by weight aluminum particles having a size of from 50 to 63 microns and 75% by weight copper particles having a size of from 63 to 106 microns. A scanning electron micrograph photo of the coated substrate is shown in FIG. 4. The aluminum regions can be clearly seen at 102 and the copper regions at 100.

While the preferred embodiment of the present invention has been described so as to enable one skilled in the art to practice the present invention, it is to be understood that variations and modifications may be employed without departing from the concept and intent of the present invention as defined in the following claims. The preceding description is intended to be exemplary and should not be used to limit the scope of the invention. The scope of the invention should be determined only by reference to the following claims.

The invention claimed is:

1. A method of coating a substrate comprising the steps of:

a) providing at least a first population of particles and a second population of particles to be sprayed each population having an average nominal diameter of from 106 to 250 microns;

b) providing a supersonic nozzle having a throat with a diameter of from 1.5 to 3.5 millimeters and located between a converging region and a diverging region, directing a flow of a gas through the nozzle, maintaining the gas at a selected temperature, and injecting the first and second populations of particles into the nozzle at the same time and entraining the first and second populations of particles in the flow of the gas;

c) the temperature of the gas selected to be insufficient to thermally soften the first population of particles in the nozzle and accelerating the first population of particles to a velocity sufficient to result in direct bonding of the first population of particles onto a substrate positioned opposite the nozzle, and the temperature of the gas selected to be sufficient to heat the second population of particles to a temperature at or above their melting temperature in the nozzle thereby melting the second population of particles and accelerating the molten second population of particles to a velocity sufficient to result in adherence of the second population of particles on the substrate; thereby forming a coating on the substrate that is a combination of the first and second populations of particles.

2. The method of claim 1, wherein step a) comprises providing at least a first and a second population of particles that differ from each other in at least one of size, shape, or material composition.

3. The method of claim 1, wherein step b) comprises providing air, argon, nitrogen, or helium as the gas.

4. The method of claim 1, wherein step b) comprises maintaining the gas at a temperature of from 300 degrees Celsius to a temperature that is seven fold above the highest melting temperature of the first and second populations of particles.

5. The method of claim 1, wherein step b) comprises injecting at least one of the first and the second populations of particles into the converging region of the nozzle prior to the throat.

6. The method of claim 1, wherein step b) comprises injecting at least one of the first and the second populations of particles directly into the diverging region of the nozzle after the throat.

7. The method of claim 1, wherein step c) comprises accelerating the first and second populations of particles to a velocity of from 300 to 1500 meters per second.

8. The method of claim 1, wherein step c) comprises heating the second population of particles to a temperature of from their melting temperature to a temperature 400 degrees Celsius above their melting temperature.

9. The method of claim 1, wherein step c) comprises heating the second population of particles to a temperature of from their melting temperature to a temperature 200 degrees Celsius above their melting temperature.

10. The method of claim 1, wherein step c) comprises heating the second population of particles to a temperature of from their melting temperature to a temperature 100 degrees Celsius above their melting temperature.

11. The method of claim 1, wherein step c) comprises positioning a substrate comprising a metal, an alloy, a ceramic, a plastic, a semi-conductor, wood, paper, or mixtures thereof opposite the nozzle.

12. The method of claim 1, wherein step a) comprises providing first and second populations of particles comprising a metal, an alloy, a ceramic, a polymer, or mixtures of thereof.

13. The method of claim 1, wherein step b) comprises injecting the first and second populations of particles each through a tube having an inner diameter of from 0.4 to 3.0 millimeters in diameter.

14. The method of claim 1, wherein step b) comprises providing the nozzle having the diverging region with a length of from 60.0 to 400.0 millimeters in length.

15. The method of claim 1, wherein step a) comprises providing a mixture of the first and the second population of particles.

* * * * *